United States Patent [19]

Echigo et al.

[11] Patent Number: 4,731,017

[45] Date of Patent: Mar. 15, 1988

[54] RADIATION HEATING APPARATUS

[75] Inventors: Ryozo Echigo, Tokyo; Toshio Tomimura, Yokohama; Chikashi Nishino, Hasaki; Noboru Sue, Urawa, all of Japan

[73] Assignee: Mitsubishi Petrochemical Engineering Co. Ltd., Tokyo, Japan

[21] Appl. No.: 22,507

[22] Filed: Mar. 9, 1987

Related U.S. Application Data

[63] Continuation of Ser. No. 792,666, Oct. 29, 1985, abandoned.

[30] Foreign Application Priority Data

Nov. 1, 1984 [JP] Japan ..... 59-228949

[51] Int. Cl.[4] ..... F27B 3/20; F24C 3/04

[52] U.S. Cl. ..... 432/175; 432/219; 432/223; 126/92 AC

[58] Field of Search ..... 432/29, 30, 72, 175, 432/219, 221, 209, 222; 126/92 AC

[56] References Cited

U.S. PATENT DOCUMENTS

| | | | |
|---|---|---|---|
| 2,181,138 | 11/1939 | Landis | 432/222 |
| 2,731,010 | 1/1956 | Moore et al. | 126/92 AC |
| 2,806,465 | 9/1957 | Hess | 126/92 AC |
| 2,895,544 | 7/1959 | Parsons | 432/175 |
| 2,962,272 | 11/1960 | Spalding | 432/222 |
| 3,150,864 | 9/1964 | Fetner et al. | 432/175 |
| 3,550,919 | 12/1970 | Cooper | 432/219 |
| 3,946,719 | 3/1976 | Bark et al. | 126/92 AC |
| 3,963,414 | 6/1976 | Jensen | 126/92 AC |
| 4,375,214 | 3/1983 | Wysong | 126/92 AC |
| 4,432,727 | 2/1984 | Faroli | 432/222 |
| 4,457,704 | 7/1984 | Sommers et al. | 432/222 |
| 4,479,535 | 10/1984 | Echigo et al. . | |

FOREIGN PATENT DOCUMENTS

| | | |
|---|---|---|
| 25353 | 1/1980 | Japan . |
| 18015 | 2/1982 | Japan . |
| 175886 | 10/1982 | Japan . |
| 198913 | 12/1982 | Japan . |
| 242 | 1/1983 | Japan . |
| 153921 | 5/1983 | Japan . |
| 49494 | 3/1984 | Japan . |
| 13894 | 3/1984 | Japan . |
| 13893 | 7/1984 | Japan . |

*Primary Examiner*—Henry C. Yuen

*Attorney, Agent, or Firm*—Sherman and Shalloway

[57] ABSTRACT

A radiation heating apparatus comprising a heating zone, a zone to be heated, a gas non-permeable boundary member defining the boundary between the two zones, and a porous radiator member provided in the heating zone, wherein a high-temperature gas is formed in, or introduced into, the heating zone and discharged at least through the porous radiator member, and the zone to be heated is heated through the gas non-permeable boundary member.

34 Claims, 10 Drawing Figures

RADIATION HEATING APPARATUS

This application is a continuation, of application Ser. No. 06/792,666 filed Oct. 29, 1985, abandoned.

This invention relates to a radiation heating apparatus. More specifically, it relates to a radiation heating apparatus comprising a heating zone, a zone to be heated and a non-gas-permeable boundary member defining the boundary of the two zones, said zone to be heated being adapted to be heated through the non-gas-permeable boundary member.

A furnace adapted for increased thermal efficiency is known in which part of the sensible heat of a burnt gas discharged with a burning gas is recovered and utilized as radiation energy.

Japanese Patent Publication No. 25353/1980 discloses a heating furnace including an air intake opening in a lower peripheral wall, a burnt gas discharge opening at the upper end, a grate above the air intake opening, and a wire net above the grate, the space below the grate forming a combustion chamber and the space between the grate and the wire net forming a heating chamber, whereby a material within the heating chamber is heated by the sensible heat of the burnt gas from the combustion chamber, part of the sensible heat of the burnt gas is recovered by the wire net, and the material is also heated by the heat of radiation from the heated wire net.

Japanese Laid-Open Utility Model Publication No. 149900/1981 discloses a heating furnace in which a burnt gas passage within a furnace body surrounded by a furnace wall is partitioned by an air-permeable solid, all the burnt gas is passed through the air-permeable solid to cause the solid to absorb the thermal energy of the burnt gas and the absorbed thermal energy is radiated upstream.

The above-described heating furnaces are characterized in that structurally, the air-permeable solid or the wire net is provided downstream of the burnt gas passage and all the burnt gas is passed through the air-permeable solid or the wire net, and functionally, the thermal energy of the burnt gas recovered by the air-permeable solid or the wire net is returned as radiation energy in the upstream direction of the burnt gas passage. In these heating furnaces, the material to be heated is directly exposed to the burnt gas.

Echigo et al. reported the results of numerical analysis of a heat-exchanger comprising a heating section (high-temperature section) and a section to be heated (low-temperature section) and an optically transparent partition wall between them in which an air-permeable solid having a high porosity placed in the heating section is heated with a high-temperature gas, and the radiation heat from the heated air-permeable solid is passed through the optically transparent partitioning wall and absorbed by an air-permeable solid provided in the low-temperature section [ASME, JSME THERMAL ENGINEERING JOINT CONFERENCE, Honolulu, Hi., held on Mar. 20 to 24, 1983; and Collection of Speeches in the 20th Japan Heat Transmission Symposium, pages 430–432, July 1 to 3, 1983, Fukuoka, Japan].

The characteristic feature of the above heat exchanger is that radiation energy from the high-temperature section is passed through the optically transparent partition wall so as to directly heat the air-permeable solid set in the low-temperature section.

It is an object of this invention is to provide a novel radiation heating apparatus having a high thermal efficiency.

Another object of this invention is to provide a novel radiation heating apparatus comprising a heating zone, a zone to be heated and a non-gas-permeable boundary member defining the boundary between the two zones, said zone to be heated being adapted to be heated through the gas non-permeable boundary member.

Still another object of this invention is to provide a novel radiation heating apparatus comprising a heating zone, a zone to be heated and a non-gas-permeable boundary member defining the boundary between the two zones, said zone to be heated being adapted to be heated by radiation energy from a porous radiator member provided in the heating zone, or by both said radiation energy and radiation energy and/or transmission energy from the non-gas-permeable boundary member.

Further objects and advantages of this invention will become apparent from the following description.

According to this invention, these objects and advantages of the invention are achieved by a radiation heating apparatus comprising a heating zone, a zone to be heated, a non-gas-permeable boundary member defining the boundary between the two zones, and a porous radiator member provided in the heating zone, wherein a high-temperature gas is formed in, or introduced into, the heating zone and discharged at least through the porous radiator member, and the zone to be heated is heated through the non-gas-permeable boundary member.

Figure 7:
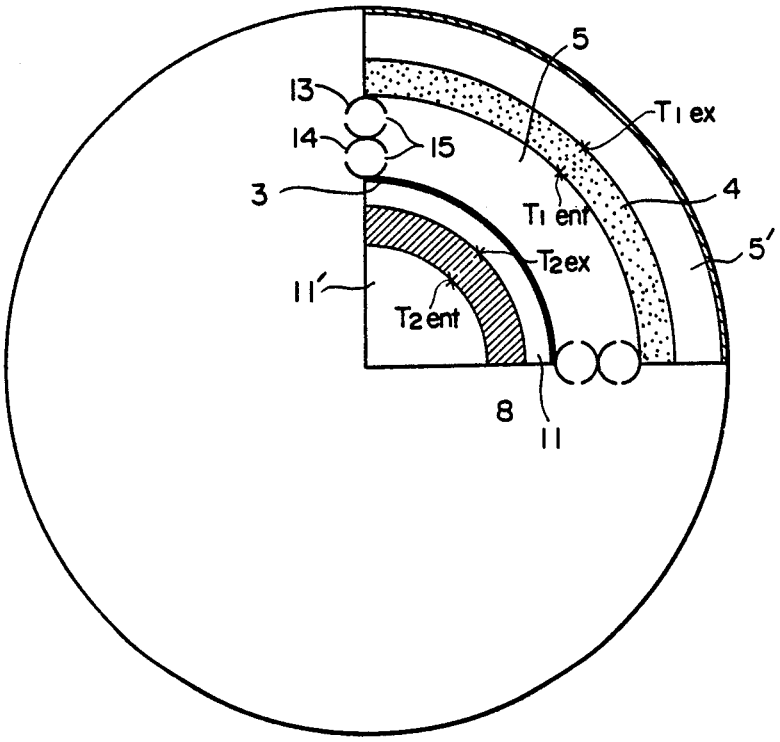
Figure 8:
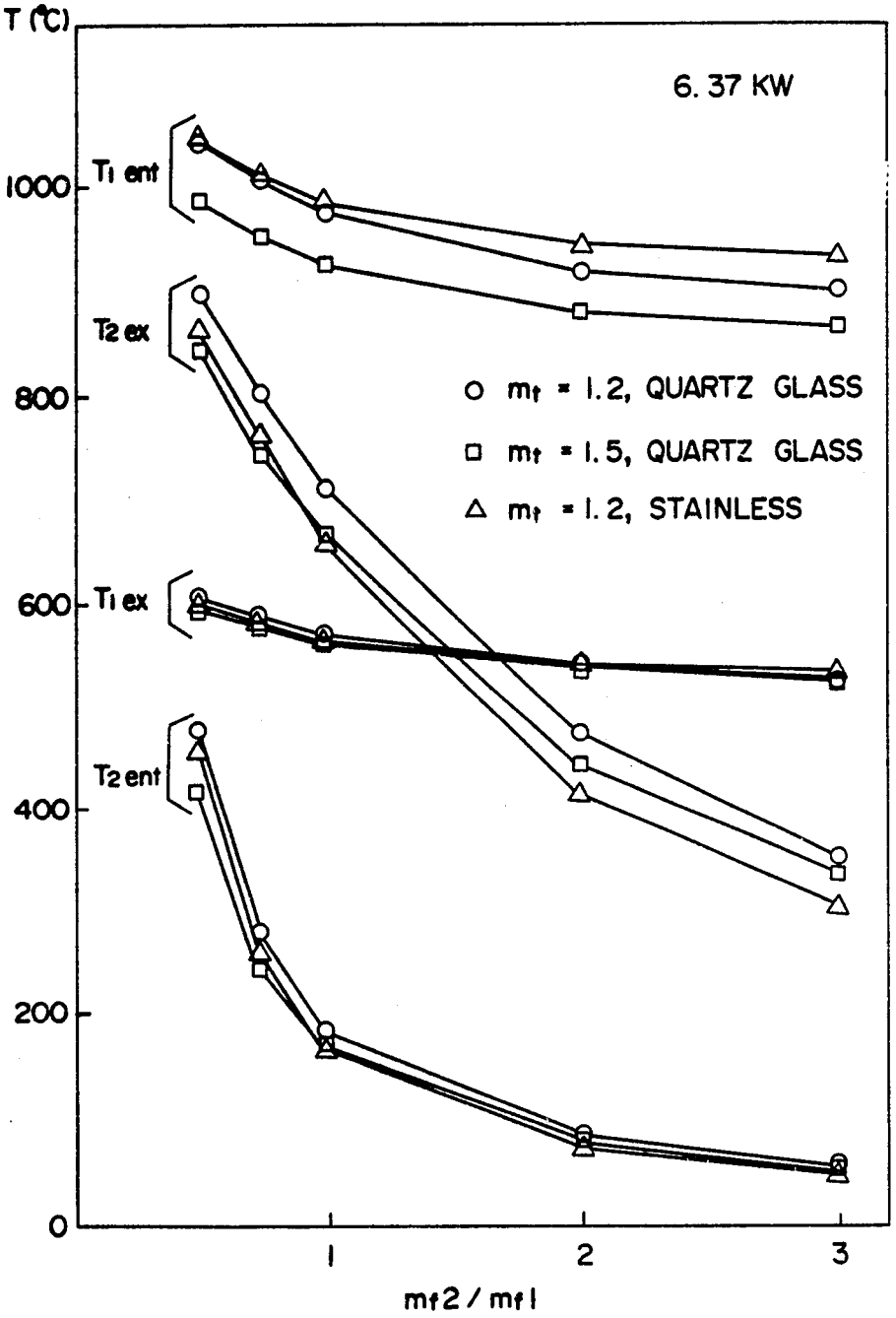
Figure 9:
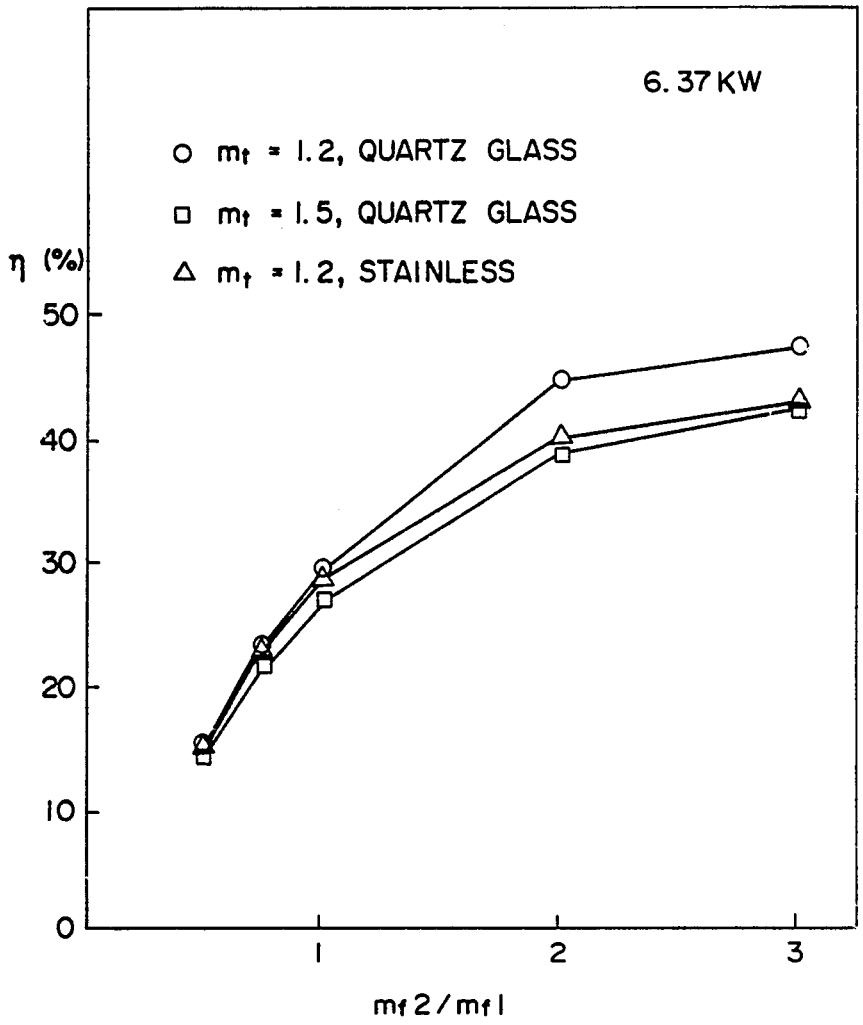

FIG. 8 is a graphic representation showing changes in the temperature of the heating zone and the heated zone plotted on the basis of the results obtained by using the radiation heating apparatus shown in FIG. 7; and FIG. 9 is a graphic representation showing changes in the rate ($\eta$, %) of increase of enthalpy in the heated zone as against the combustion load in the heating zone plotted on the basis of the results obtained by using the radiation heating apparatus shown in FIG. 7.

The radiation heating apparatus of this invention has a heating zone and a zone to be heated with a gas non-permeable boundary member positioned therebetween. A porous radiator member is provided in the heating zone. A high-temperature gas formed in, or introduced into, the heating zone (the zone including the porous radiator member) is discharged through the porous radiator member. Consequently, the sensible heat of the high-temperature gas moves to the porous radiator member and thereby heats the porous radiator member to a high temperature.

The high-temperature gas may be a burnt gas or other high-temperature gases. When the burnt gas is used as the high-temperature gas, the radiation heating apparatus of this invention may include a burning zone within the heating zone inlcuding the porous radiator member to form a burnt gas by burning a fuel. When the high-temperature gas is other than the burnt gas, for example steam, it is formed outside the heating zone, and therefore, the above burning zone is not essential in the radiation heating apparatus of this invention. Even when the high-temperature gas is a burnt gas, it can be formed outside the heating zone. Hence, the burnt gas can of course be used as the high-temperature gas in the radiation heating apparatus of this invention not including the burning zone.

The porous radiator member provided in the heating zone must permit discharge therethrough of the high-temperature gas formed in or introduced into the heating zone. The thermal energy of the high-temperature gas discharged is recovered by the porous radiator member and radiated from it as the heat of radiation.

So far as the high-temperature gas is discharged through the porous radiator member, the relative positions of the porous radiator member and the non-gas-permeable boundary member in the heating zone are optional. For example, the porous radiator member may be positioned away from, or in substantial contact with, the non-gas-permeable boundary member. When they are spaced from each other, the space between them is, for example, not more than 1,000 mm, preferably not more than 500 mm. In this case, it is advantageous to introduce or form the high-temperature gas into or in the space between the non-gas-permeable boundary member and the porous radiator member, but it is also possible to introduce or form the high-temperature gas into or in the pores of the porous radiator member. When a burning flame is to be formed within the aforesaid space, the space between the non-gas-permeable boundary member and that surface of the porous radiator member which faces the boundary member should be broad enough for the formation of the burning flame. In this case, it is advantageous to form the burning flame in the vicinity of that surface of porous radiator member which faces the boundary member in the aforesaid space.

When the porous radiator member is in substantial contact with the non-gas-permeable boundary member, the high-temperature gas is introduced into or formed in the pores of the porous radiator member. When a burning flame is to be formed in the pores of the porous radiator member, it is possible to form it in that part of the porous radiator member which faces the non-gas-permeable boundary member, to provide a zone at least not forming a burning flame within the pores of the other side of the porous radiator member (the pores of the porous radiator member which are on the opposite side to the non-gas-permeable boundary member), and to discharge the burnt exhaust gas through this zone. Alternatively, a space free from the porous radiation member is provided between that zone of the porous radiation member in which the burning flame is formed and that zone of the porous radiation member in which the burning flame is not formed, and the burnt exhaust gas from the zone in which the burning flame is formed is discharged through that space and the zone in which the burnt flame is not formed.

When the burning flame is formed within the pores of the porous radiation member, it is advantageous that the porosity of the radiator member in the zone in which the burning flame is formed is larger than that of the porous radiator member in the zone in which the burning flame is not formed.

The porosity of the porous radiator means is, for example, 60 to 99% by volume, and within this preferred porosity range, the porous radiator member gives a preferred radiation heating apparatus in accordance with this invention.

The porous radiator member may be made of a porous structure of a metal, metal oxide, ceramic or mineral. The porous radiator member may, for example, be in the form of a plate, a block, or a block or annular structure having at least one hollow passage extending therethrough.

In the apparatus of this invention, the non-gas-permeable boundary member may be made of a material substantially optically transparent to radiation energy, for example quartz glass. It may also be made of a material substantially optically non-transparent to radiation energy, for example a heat-resistant metallic material, a heat-resistant metal oxide material or a heat-resistant ceramic material.

Examples of the heat-resistant metallic material include stainless steel or high alloys such as chromium-copper or molybdenum-copper. Examples of the heat-resistant metal oxide material are aluminum oxide and titanium oxide. Examples of the heat-resistant ceramics are cordierite and mullite.

The non-gas-permeable boundary member is, for example, in the form of a thin film, a plate, a ring or a tube.

The general structure of the radiation heating apparatus of this invention may be that the heating zone and the zone to be heated are juxtaposed with the non-gas-permeable boundary member therebetween, or the heating zone surrounds the zone to be heated or vice versa. In other words, the radiation heating apparatus of this invention may, for example, be an apparatus in which the porous radiator member exists on at least one side of the non-gas-permeable boundary member, the high-temperature gas is formed in, or introduced into, that zone in which the porous radiator member exists, and a zone existing on the other side of the non-gas-permeable boundary member is used as the zone to be heated; an apparatus in which the porous radiator member exists exteriorly of the non-gas-permeable boundary member, the high-temperature gas is formed in, or introduced into, the outside zone in which the porous radiator member exists, and the zone interiorly of the boundary member is used as the zone to be heated; or an apparatus in which the porous radiator member exists interiorly of the non-gas-permeable boundary member, the high-temperature gas is formed in, or introduced into, the interior zone in which the porous radiator member exists, and the exterior of the boundary member is used as the zone to be heated.

According to the apparatus of this invention, a material provided within the zone to be heated is heated directly (when the non-gas-permeable boundary member is made of a material optically transparent to the radiation energy) or indirectly (when the non-gas-permeable boundary member is made of a material optically non-transparent to the radiation energy) at least by the radiation energy emitted from the porous radiator member located within the heating zone.

The apparatus of this invention may have in the zone to be heated a heat receiving member different from the material to be heated. The heat-receiving member may be made of, for example, a porous, air-permeable, refractory structure of a metal, metal oxide, ceramic or mineral in order to receive heat efficiently from the heating zone and transmit it effectively to the material to be heated. The heat-receiving member may be in the shape of a plate or block or an aggregate of pellets or rings.

A desired reaction may be carried out in the apparatus of this invention by, for example, supporting a catalyst for the desired reaction on the heat-receiving member, and passing a material to be heated, a fluid to be heated as a reaction reagent or at least one reactive gas through the heat-receiving member.

According to a preferred embodiment of the radiation heating apparatus of this invention, the heat-receiving member in the zone to be heated is heated (a) by the direct heating of the boundary member with the high-temperature gas, and (b) by the heating of the boundary member with the heat of radiation from the porous radiator member, in that zone of the apparatus which is opposite to the zone to be heated with respect to the boundary member (i.e., the heating zone).

With reference to the accompanying drawings, some embodiments of the radiation heating apparatus of this invention will be described.

Figure 1:
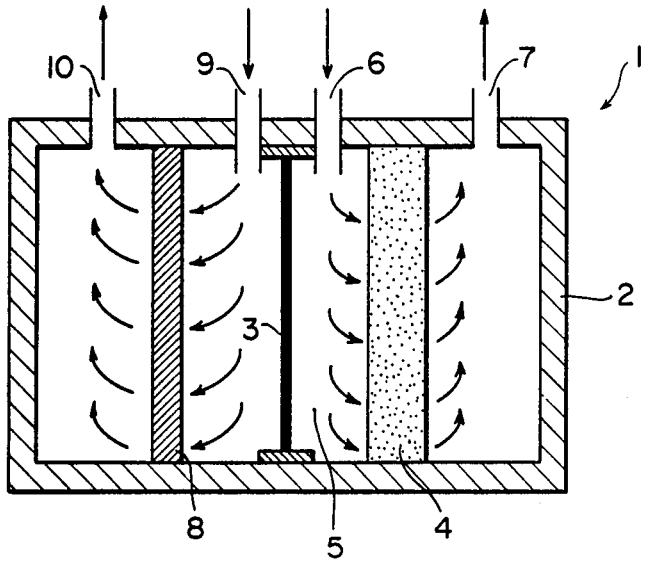
FIG. 1 is a rough sectional view of one embodiment of the radiation heating apparatus of this invention.

FIG. 1 shows a rough sectional view of one embodiment of the radiation heating apparatus this invention.

The radiation heating apparatus 1 shown in FIG. 1 is defined by a wall member 2, and its inside is partitioned into two zones, i.e. a heating zone (in a right zone in the drawing) and a zone to be heated (a left zone in the drawings), by means of a non-gas-permeable boundary member 3. In the heating zone, a porous radiator member 4 is positioned away from the non-gas-permeable member. A high-temperature gas is introduced from a high-temperature gas inlet 6 in the direction shown by an arrow into a space 5 defined by the wall member 2, the boundary member 3 and the porous radiator member 4. The introduced gas passes through the pores of the porous radiator member 4 in the direction shown by arrows (from right to left in the drawing) and is discharged out of the apparatus 1 from a gas outlet 7. The porous radiator member 4 heated to a high temperature heats the zone to be heated through the non-gas-permeable member without particularly contaminating the high-temperature gas. In FIG. 1, a heat-receiving member exists in the zone to be heated, and receives the heat from the porous radiator member 4 in the heating zone. The heat-receiving member 8 may, for example, be porous, in which case the material to be heated, for example a gas or liquid, is introduced from an inlet 9, passes through the pores of the heat-receiving member 8, and is taken out of the apparatus from an outlet 10.

In the apparatus of FIG. 1, the high-temperature gas is formed outside the apparatus, and introduced into the apparatus. If desired, a burner may be directly provided at the site of the high-temperature gas inlet 6 so as to burn fuel and produce the high-temperature gas. A plurality of high-temperature gas inlets or a plurality of burners may be provided along the peripheral edge of the non-gas-permeable member 3 so that they are directed toward the space 5.

Advantageously, the porous radiator member 4 has a porosity of 60 to 99% by volume as stated hereinabove. Within this porosity range, the porous radiator member advantageously has such a pore distribution that most of the pores have a diameter in the range of 0.01 to 10 mm. As stated above, the porous radiator member may be made of various materials. It may be made of a sintered body of ceramics or metal, or may be an aggregate of wire nets having an opening size of 0.1 to 10 mm.

Figure 2A:
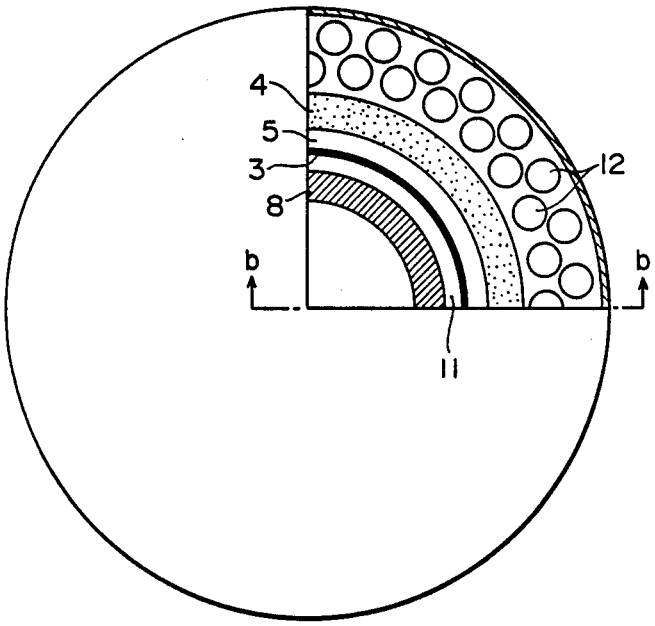
FIG. 2 shows another embodiment of the radiation heating apparatus of this invention, FIG. 2 (*a*) being a rough partial sectional view thereof and FIG. 2 (*b*) being a rough partial vertical sectional view thereof.
Figure 2B:
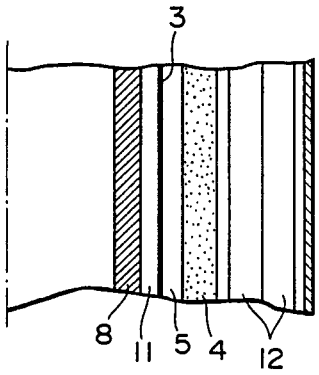

FIG. 2 shows another embodiment of the radiation heating apparatus of this invention in which a heating zone and a zone to be heated are arranged concentrically with a non-gas-permeable boundary member therebetween. FIG. 2, (*a*) is a rough partial cross-sectional view of the apparatus, and FIG. 2, (*b*), a rough partial vertical sectional view. In FIGS. 2 (*a*) and (*b*), the same reference numerals as in FIG. 1 have the same meaning as in FIG. 1 (as is the case with the embodiments shown in the other drawings).

The apparatus shown in FIG. 2 has such a structure that the zone to be heated exists inwardly of the non-gas-permeable boundary member 3, and the heating zone exists outwardly of the boundary member 3. A high-temperature gas is introduced into, or formed in, the space 5, passes through the pores of the porous radiator member 4, and heats the porous radiator member 4 to a high temperature. The porous radiator member 4 heated to a high temperature heats the zone inwardly of the boundary member 3. The heat-receiving member 8 existing in the zone to be heated is heated by receiving the heat of radiation from the heating zone and the non-gas-permeable boundary member. Accordingly, a desired reaction may be carried out in this apparatus by using a porous carrier supporting a catalyst for the desired reaction or a porous material showing catalytic activity by itself as the heat-receiving member 8, introducing a reactive gas into a space 11 between the heat-receiving member 8 and the non-gas-permeable boundary member 3, and passing it through the pores of the heat-receiving member 8.

The apparatus shown in FIG. 2 further includes a heat recovering portion 12 for further recovering thermal energy still possessed by the high-temperature gas which has passed through the pores of the porous radiation member. The heat-recovering portion 12 is located outwardly of the porous radiator member, and is made of, for example, a metallic pipe. A heat-recovering medium is passed through the interior of the heat-recovering portion 12 and the heat is recovered by the medium.

Figure 3:
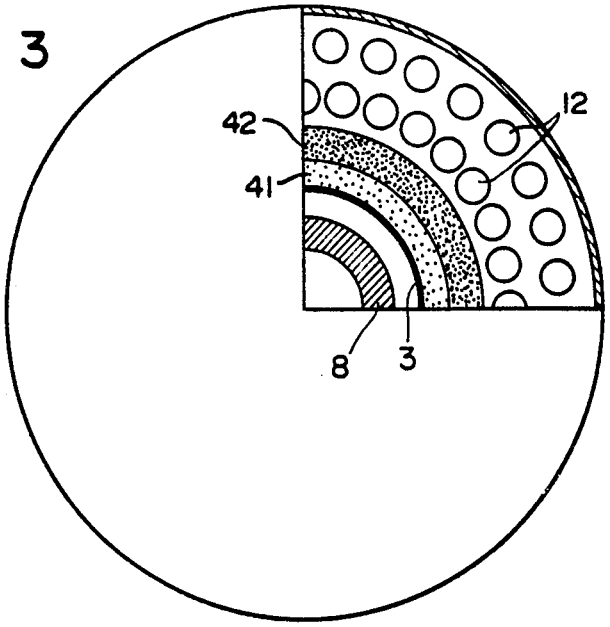
FIGS. 3 to 7 are rough cross-sectional views of other different embodiments of the radiation heating apparatus of this invention.

FIG. 3 is a rough partial cross-sectional view of another embodiment of the radiation heating apparatus of this invention, similar to the apparatus of FIG. 2, which has such a structure that a zone to be heated exists inwardly of the non-gas-permeable boundary member 3 and a heating zone is present outwardly of the boundary member 3. The great difference from the apparatus shown in FIG. 2 is that a porous radiator member 41 having a relatively large porosity, for example a ceramic sintered body having a porosity of 70 to 99% by volume, exists in substantial contact with the boundary member 3 in the heating zone, and a porous radiator member 42 having a relatively smaller porosity, for example a ceramic sintered body having a porosity of 60 to 90% by volume, exists outwardly of the porous radiator member 41. A high-temperature gas is formed in, or introduced into, at least the pores of the porous radiator member 41 and passes through the pores of the porous radiator member 42. The remaining sensible heat is recovered by the heat-recovering portion 12. The heat of radiation from the porous radiator members 41 and 42 is all radiated toward the non-gas-permeable boundary member 3 through the pores of these radiator members 41 and 42 and heats the heat-receiving member 8 in the zone to be heated.

Figure 4:
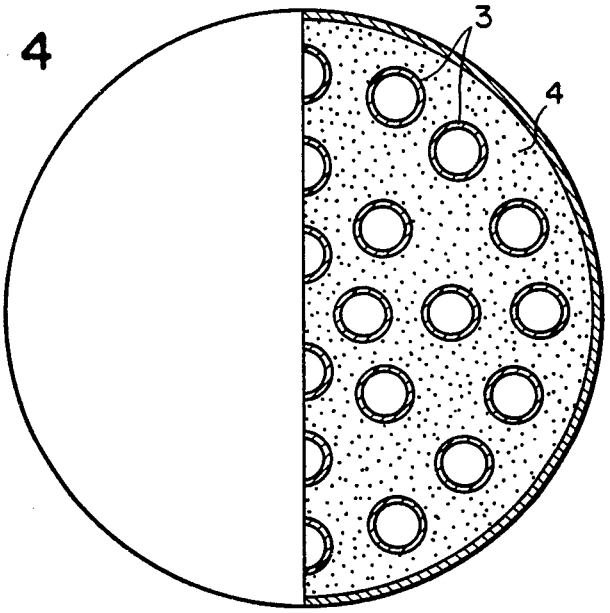

FIG. 4 is a rough cross-sectional view of still another embodiment of the radiation heating apparatus of this invention. The apparatus of FIG. 4 comprises a onepiece radiator member 4, a plurality of cylindrical passages provided in the member 4, and boundary members in the form of a pipe composed of a non-gas-permeable material such as metal being positioned in the cylindrical passages.

The porous radiator member 4 is desirably composed of a porous radiator having a relatively large porosity. A high-temperature gas introduced into the pores of the porous radiator member 4 from the back of the sheet in FIG. 4 toward its surface passes through the porous radiator member 4 and heats the porous radiator member and also directly heats the boundary member 3. The space within the pipe of the boundary member 3 forms a zone to be heated, and is heated by the heat from the heating zone formed by the porous radiator member 4. Accordingly, a material to be heated can be continuously heated at a desired temperature by, for example, passing the above material continuously through the pipe.

Figure 5:
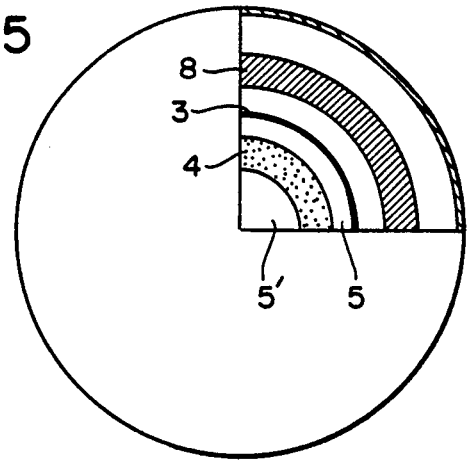

FIG. 5 is a rough cross-sectional view of still another embodiment of the radiation heating apparatus of this invention.

The apparatus of FIG. 5, contrary to the apparatus of FIG. 2, is of such a structure that a zone to be heated exists outwardly of the non-gas-permeable boundary member 3 and a heating zone exists inwardly of the boundary member 3. A high-temperature gas is introduced into, or formed in, the space 5, passes through the pores of the porous radiator member 4 to heat the porous radiator member 4 to a high temperature, and is discharged out of the apparatus through a central space 5'. The porous radiator member heated to a high temperature heats the outside zone through the boundary member 3. At this time, the heat-receiving member 8 existing in the zone to be heated is heated by receiving the heat of radiation from the heating zone and the gas non-permeable boundary member. As in the apparatus shown in FIG. 2, a desired reaction may be carried out in the apparatus of FIG. 5 by using a porous body having catalytic activity as the heat-receiving member 8 and introducing a reactive gas into the zone to be heated and passing it through the pores of the heat-receiving member 8.

Figure 6:
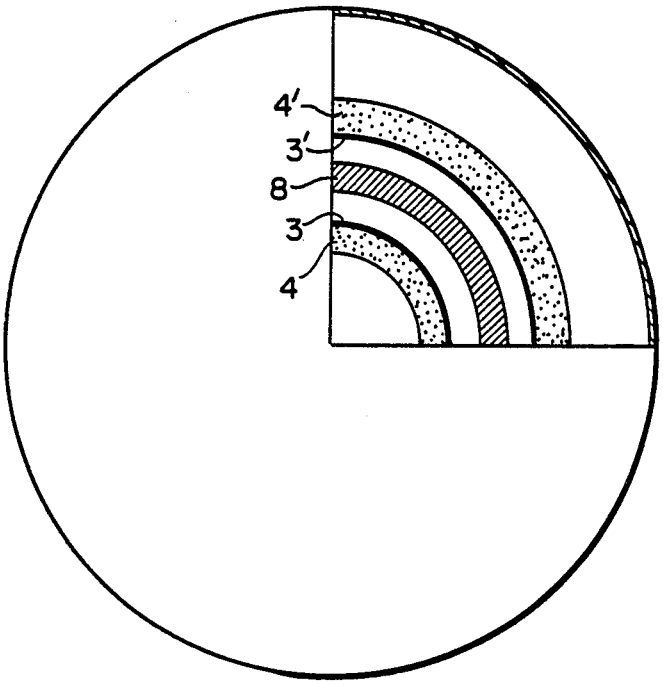

FIG. 6 is a rough cross-sectional view of still another embodiment of the radiation heating apparatus of this invention.

The apparatus of FIG. 6 is of such a structure that it has two gas non-permeable boundary members 3 and 3', a space defined by these boundary members forms a zone to be heated, and two heating zones are formed respectively opposite to the zone to be heated with respect to the boundary members. A porous radiator member 4' is located outwardly of the boundary member 3', and a porous radiator member 4 exists inwardly of the boundary member 3. A high-temperature gas introduced into, or formed in, the pores of the porous radiator members 4 and 4' heats these porous radiator members, and the zone to be heated is heated by the heat of radiation from the boundary members 3' and 3. According to this heating apparatus, a relatively uniform temperature distribution in the radial direction within the plane of the sheet surface of FIG. 6 can be easily provided within the space of the zone to be heated. Accordingly, the apparatus shown in FIG. 6 can be vary advantageously used for carrying out a reaction particularly requiring heating at a relatively uniform temperature. The reaction can be carried out by using a heat-receiving member having catalytic activity as the heat-receiving member 8 within the zone to be heated, and passing a reactive gas through the zone to be heated.

By using a cylindrical radiation heating apparatus of the type shown in FIG. 7, changes in temperatures in a zone to be heated were examined. In FIG. 7, the reference numerals 3, 4, 5, 8 and 11 have the same meanings as in FIG. 1. Basically, the radiation heating apparatus of FIG. 7 is similar to the apparatus shown in FIG. 2, but differs from the latter in that it does not have the heat recovering portion present in the apparatus of FIG. 2 and it additionally includes secondary air tubes 13 and partial pre-mixing gas tubes 14. Accordingly, the space 5 in this apparatus is partitioned into four spaces by four sets of the tubes 13 and 14. Each of the secondary air tubes 13 and the partial premixing gas tubes 14 has a plurality of holes 15 arranged in the direction of its height. By passing air through the secondary air tubes 13, the amount of air to be introduced into the space 5 can be regulated. Furthermore, it is possible to introduce a fuel, for example a mixture of methane gas and air, into the space 5 from the partial pre-mixing gas tube 14, and burn it there. The following experiment was carried out.

Air and a mixture of air and methane gas were introduced into the space 5 respectively from the secondary air tubes 13 and the partial pre-mixing gas tubes 14, and burnt there. The burnt gas passed through the porous radiator member 4, and during this time, heated the porous radiator member 4. It got into the space 5' and was discharged. In the zone to be heated, air passing through the porous heat-receiving member from the space 11 to the space 11' was introduced into the space 11.

FIGS. 8 and 9 show the results obtained. In FIGS. 8 and 9, the various symbols used have the following meanings.

$T_{1ent}$: the temperature (°C.) of the front surface of the porous radiator member $T_{1ex}$: the temperature (°C.) of the rear surface (discharge side) of the porous radiator member $T_{2ent}$: the temperature (°C.) of the front surface of the porous heat-receiving member $T_{2ex}$: the temperature (°C.) of the rear surface of the porous heat-receiving member $m_{f1}$: the flow rate of air in the heating zone (mole/sec)

$m_{f2}$: the flow rate of air in the zone to be heated (mole/sec)

$m_t$: the air excess ratio (the ratio to the theoretical amount of air required for complete combustion)

In FIGS. 8 and 9, the circles and squares show the results of a run in which the gas non-permeable member is a quartz plate optically transparent to radiation energy. The triangles show the results of a run in which the gas non-permeable member is a stainless steel plate substantially non-transparent optically to radiation energy.

It is surprising that even when the gas non-permeable member is a stainless steel plate substantially non-transparent optically to radiation energy, the temperature of the zone to be heated is increased in quite the same manner as in the case of using the quartz plate (FIG. 8). FIG. 9 shows the quotient ($\eta$, %) obtained by dividing the increase of the enthalpy of the porous heat-receiving member in the zone to be heated by the burning load (6.37 KW) of the heating zone. In both of these runs, the burning load was 6.37 KW.

What is claimed is:

1. A radiation heating apparatus comprising within a housing therefor, (a) a first heating zone, (b) a second zone to be heated through a gas non-permeable boundary member, (c) said gas non-permeable boundary member separating and defining the boundary between the two zones and being made of a material substantially optically non-transparent to radiation energy, (d) at least one means selected from means for generating or introducing a high-temperature gas, said means being positioned in a sub-zone within the heating zone adjacent to the boundary member, (e) a porous radiator member in the heating zone, said porous radiator member having pores through which the high-temperature gas formed in, or introduced into the sub-zone is discharged, and (f) a porous heat-receiving member in the zone to be heated, whereby said porous heat-receiving member is heated through the gas non-permeable boundary member.

2. The apparatus of claim 1 wherein the means for generating or introducing a high-temperature gas comprises means for generating or introducing a burnt gas.

3. The apparatus of claim 2 wherein the means for generating or introducing burnt gas is positioned in a burning zone within the heating zone adjacent to the boundary member.

4. The apparatus of claim 2 wherein the means for generating or introducing a burnt gas is positioned externally of said housing and includes means for introducing the burnt gas into the heating zone adjacent to the boundary member.

5. The apparatus of claim 1 wherein the means for generating or introducing a high-temperature gas is positioned externally of said housing and includes means for introducing the high-temperature gas into the heating zone adjacent to said boundary member.

6. The apparatus of claim 5 wherein the high-temperature gas generating means is a stream generator.

7. The apparatus of claim 1 wherein the porous radiator member is positioned away from the gas non-permeable boundary member.

8. The apparatus of claim 7 wherein a space at least sufficient for forming a burning flame is provided between the non-gas-permeable boundary member and that surface of the porous radiator member which faces the boundary member.

9. The apparatus of claim 1 wherein the porous radiator member is spaced from the gas non-permeable boundary member by a distance of less than 1000 mm.

10. The apparatus of claim 9 wherein the porous radiator member is spaced from but within 500 mm of the gas non-permeable boundary member.

11. The apparatus of claim 1 wherein the porous radiator member is spaced from the non-gas-permeable bounary member, and within said sub zone, a burning flame is formed in the vicinity of that surface of the porous radiator member which faces the boundary member.

12. The apparatus of claim 1 wherein the porous radiator is in substantial contact with the gas non-permeable boundary member.

13. The apparatus of claim 1 wherein the porous radiator member is in substantial contact with the non-gas-permeable boundary member, and means are provided for forming a burning flame in the pores of the porous radiator member.

14. The apparatus of claim 1 wherein the porous radiator member is in substantial contact with the non-gas-permeable boundary member, said apparatus further comprising means for forming a burning flame on that side of the porous radiator member which faces the non-gas-permeable boundary member, a further sub-zone in which at least a burning flame is not formed on the other side of the porous radiator member not facing the gas non-permeable boundary member, and discharge means for discharging the burnt waste gas through this non-burning flame sub zone.

15. The apparatus of claim 14 wherein a space not including the porous radiator member exists between that area of the porous radiator member in which the burning flame is formed and that area of the porous radiator member in which no burning flame is formed.

16. The apparatus of claim 15 wherein the porosity of the porous radiator member in that area in which the burning flame is formed is larger than that of the porous radiator member in that area in which no burning flame is formed.

17. The apparatus of claim 1 wherein the porous radiator member is made of a molded structure of a porous metal, a porous metal oxide, a porous ceramic or a porous mineral.

18. The apparatus of claim 1 wherein the porous radiator has a porosity of 60 to 99% by volume.

19. The apparatus of claim 1 wherein the porous radiator member is in the form of a plate, a block or a block or annular body having at least one hollow passage.

20. The apparatus of claim 1 wherein the non-gas-permeable boundary member is made of a heat-resistant metallic material, a heat-resistant metal oxide material or a heat-resistant ceramic material.

21. The apparatus of claim 1 wherein the non-gas-permeable boundary member is in the form of a thin film, a plate, a ring or a tube.

22. The apparatus of claim 1 wherein the porous radiator member exists outwardly of the non-gas-permeable member and the high-temperature gas forming or introducing means is located outwardly of the non-gas-permeable boundary member and inwardly of the porous radiator member, and the zone to be heated exists inwardly of the boundary member.

23. The apparatus of claim 1 wherein the porous radiator member exists inwardly of the non-gas-permeable boundary member and the high-temperature gas forming or introducing means is located inwardly of the non-gas-permeable boundary member, and the zone to be heated exists outwardly of the boundary member.

24. The apparatus of claim 1 wherein the heat-receiving member is positioned to be heated by (a) the direct heating of the boundary member with the high-temperature gas, and (b) the heating of the boundary member by the heat of radiation from the porous radiation member, in the heating zone.

25. The apparatus of claim 1 wherein the heat-receiving member is made of a porous, air-permeable, refractory structure of metal, metal oxide, ceramic or mineral.

26. The apparatus of claim 1 wherein the heat-receiving member is a porous, air-permeable, refractory plate or block or a porous, air-permeable, refractory aggregate of pellets or rings.

27. The apparatus of claim 1 which further comprises a catalyst for a reaction supported on the heat-receiving member.

28. The apparatus of claim 27 which further comprises means for passing a fluid to be heated through the heat-receiving member.

29. The apparatus of claim 27 which further comprises means for passing at least one reactive gas through the heat-receiving member.

30. A radiation heating apparatus comprising a housing member;

a first zone located within said housing member, said first zone including means for receiving or generating a high-temperature gas;

a second zone located within said housing member, said second zone including means for receiving therein a substance to be heated by heat provided by said high-temperature gas;

a gas non-permeable boundary member in contact with, and separating from each other, said first and second zones and being made of a material substantially optically non-transparent to radiation energy;

a porous radiator member located in said first zone and positioned therein in heat-flow relationship to said boundary member; and means for flowing the high-temperature gas through the porous radiator member in a direction generally away from said boundary member;

whereby, in operation, high-temperature gas flows through said porous radiator member to raise the temperature thereof and heat radiated from said heated porous radiator member contacts said gas non-permeable boundary member and said heat is in turn radiated from and/or transmitted through said boundary member into said second zone to thereby heat said substance in said second zone.

31. The apparatus of claim 30 which comprises a housing member;

a planar gas-non-permeable boundary member extending across and dividing said housing member into first and second zones;

a porous radiator member located in said first zone in parallel to and spaced away from said boundary member;

a high-temperature gas inlet for introducing high-temperature gas into the space between the gas non-permeable boundary member and the porous radiator member;

a high-temperature gas outlet for exhausting the high-temperature gas from the first zone after the gas flows through and heats the porous radiator member to an elevated temperature; and a heat-receiving member located in said second zone for receiving heat from said gas non-permeable boundary member.

32. The apparatus of claim 30 which comprises a generally cylindrical housing member;

a generally cylindrical gas non-permeable boundary member concentrically located within said housing member and dividing said housing member into first and second zones;

a generally cylindrical porous radiator member concentrically located within said first zone;

a generally cylindrical heat-receiving member concentrically located within said second zone; and means for generating in or introducing into the first zone adjacent to said boundary member a high-temperature gas.

33. A method for raising the temperature of a substance in a temperature raising zone of radiation heating apparatus by exposing the substance to radiant heat energy passing through or from a gas non-permeable boundary member which separates the temperature raising zone of the apparatus from a heating zone of the apparatus said boundary member being made of a material substantially optically non-transparent to radiation energy, wherein the heating zone includes therein a porous radiator member, said method comprising, generating a high-temperature gas;

passing the high-temperature gas through the porous radiator member in a direction away from the gas non-permeable boundary member whereby the porous radiator member is brought to an elevated temperature to generate radiant energy;

allowing the radiant energy generated by the porous radiator member to be absorbed by and/or transmitted through the gas non-permeable boundary member into the temperature raising zone whereby the temperature of the substance to be heated is raised by the heat energy transmitted through or by the boundary member.

34. The method of claim 33 which further comprises using the heat energy transmitted through or by the boundary member to heat said heat-receiving member located in said temperature raising zone, and heating said substance with the heat radiated by the heated heat receiving member.

* * * * *